United States Patent [19]

Ueda

[11] 4,287,500

[45] Sep. 1, 1981

[54] THERMAL PROTECTOR

[75] Inventor: Kensaku Ueda, Takatsuki, Japan

[73] Assignee: Matsushita Electric Industrial Co., Ltd., Osaka, Japan

[21] Appl. No.: 53,996

[22] Filed: Jul. 2, 1979

[30] Foreign Application Priority Data

Jul. 7, 1978 [JP] Japan ..... 53/94072[U]

[51] Int. Cl.[3] ..... H01H 61/02; H01H 63/013; H01H 71/16

[52] U.S. Cl. ..... 337/107; 337/102; 338/22 R; 219/505; 219/511

[58] Field of Search ..... 337/107, 106, 105, 104, 337/103, 102; 338/331, 332, 22 R, 204, 205; 361/8, 13, 106; 219/505, 511

[56] References Cited

U.S. PATENT DOCUMENTS 3,272,944 9/1966 Ricker et al. ..... 337/107

*Primary Examiner*—Harold Broome

*Attorney, Agent, or Firm*—Burgess, Ryan & Wayne

[57] ABSTRACT

A thermal protector of the type comprising a stationary electrode, a movable electrode having a heat responsive element which is disposed in opposite relationship with the stationary electrode, a block of a thermistor with a positive thermal coefficient and having two axial through holes, and electrically conductive sleeves which are partially inserted into or fully extended through the holes of the block, the stationary and movable electrodes being extended through sleeves. The thermal protector can precisely operate at a predetermined temperature and exhibit high resistance to vibration so that it is highly reliable and dependable in operation.

6 Claims, 14 Drawing Figures

THERMAL PROTECTOR

BACKGROUND OF THE INVENTION

The present invention relates to a thermal protector and more particularly a thermal protector of the type which is reset by removing the unpressed voltage so as to close the contacts after the latter are opened as the environmental temperature rises to a predetermined level.

In general the thermal protectors have a stationary electrode and a movable electrode having a heat responsive element such as bimetal. When the environmental temperature rises to a predetermined level, the stationary and movable electrodes are moved away from each other so as to interrupt the current flowing into a load which is connected to a power source through the thermal protector. They are widely used as safety devices for preventing overheating of various types of electrical machinery and equipment.

Resettable type thermal protectors wherein the stationary and movable electrodes are bridged with a heat sensitive resistor with a positive thermal coefficient are known. More particularly, the heat responsive resistor element is inserted into a recess formed in the movable electrode and is pressed against it under the force of a leaf or plate spring extending from the stationary electrode so that the heat responsive resistor element may be securely clamped between them.

The thermal protector of the type described, however, has the disadvantage that since the heat responsive resistor element is mechanically clamped between the stationary and movable electrodes as described above, the thermal protector is not reliable and dependable in operation. It cannot be certain that the thermal protector will precisely open its contacts at a predetermined environmental temperature and the thermal protector exhibits less resistance to vibration.

SUMMARY OF THE INVENTION

The primary object of the present invention is to provide a manually resettable thermal protector which operates precisely at a preset temperature and exhibits high resistance to vibration.

Briefly stated, the present invention comprise a stationary and a movable electrode which are extended through electrically conductive sleeves which in turn are partially inserted into or extended through axial through holes in a block of a heat responsive resistor element with a positive temperature coefficient.

BRIEF DESCRIPTION OF THE DRAWINGS

The same reference numerals are used to designate similar parts throughout the figures.

DESCRIPTION OF THE PREFERRED EMBODIMENTS

Figure 1:
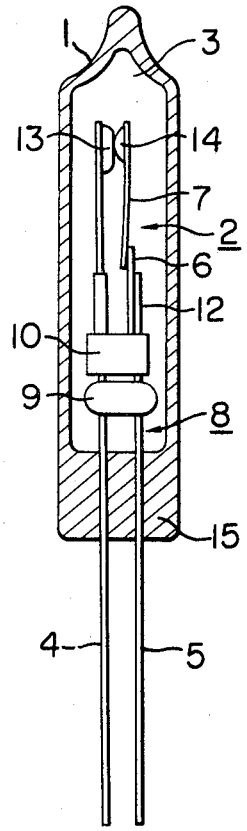
FIG. 1 is an axial sectional view of a first embodiment of a thermal protector in accordance with the present invention.

First Embodiment, FIGS. 1 and 2

In FIG. 1 is shown in longitudinal section a first embodiment of a thermal protector in accordance with the present invention having a glass bulb 1 which is sealed together with an electrode mount 2 at 15 and filled with dry air 3. The glass bulb 1 is 7.5 mm in outer diameter, 33 mm in length and 0.5 mm in wall thickness.

The electrode mount 2 has a stationary electrode 4 which is 0.7 mm in diameter and 57.5 mm in length (the extension out of the glass bulb 1 being 33 mm in length); a movable electrode 8 consisting of a lead 5 which is 0.7 mm in diameter and 48.5 mm in length (the extension out of the glass bulb 1 being 33 mm in length), a subplate 6 and a heat-responsive element 7 which comprises for instance a bimetal plate 10 mm in length, 5 mm in width and 0.1 mm in thickness; a glass bead 9 which serves to maintain the stationary and movavle electrodes 4 and 8 in a predetermined spaced apart relationship; a block 10 which comprises a heat responsive resistor with a positive temperature coefficient (to be referred to as "the positive thermistor" in this specification) which is 5 mm in diameter and 2.2 mm in thickness, having two holes through the element the wall surfaces of which are coated with silver films which in turn serve as electrodes, the positive thermistor barium titanate and exhibit a resistance of 1 kilo-ohm at 20° C.; and two electrically conductive sleeves 11 and 12 which are made of nickel and are 1.1 mm in outer diameter, 0.1 mm in wall thickness and 5 mm in length (the extension out of the block 10 being 2.8 mm in length) and are fitted into the holes of the block 10. A silver contact 13 is welded to the leading end of the stationary electrode 4 while a silver alloy contact 14 is welded to the leading end of the heat responsive element 7. The stationary electrode 4 and the lead 5 are extended through the sleeves 11 and 12, respectively.

Figure 2A:
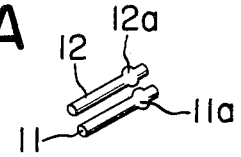
FIGS. 2A–2F are exploded perspective views of an electrode mount of the thermal protector shown in FIG. 1; which show the steps of assembly of the electrode mount.
Figure 2B:
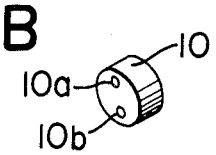
Figure 2C:
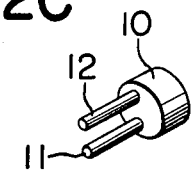
Figure 2D:
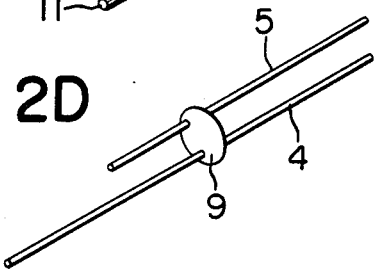
Figure 2E:
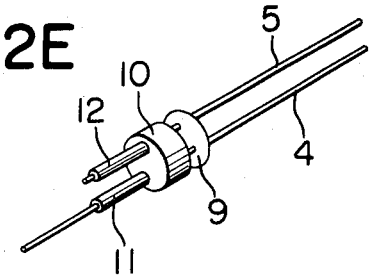
Figure 2F:
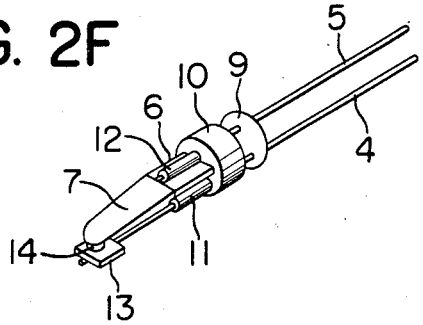

Next referring further to FIG. 2, the steps of fabrication of the thermal protector with the above construction will be described. First the sleeves 11 and 12, which are illustrated in FIG. 2A, are fitted into the holes **10*a* and 10*b*, respectively, of the block 10 of the positive thermistor shown in FIG. 2B. Since the sleeves 11 and 12 are formed with enlarged diameter portions 11*a* and 12*a* which are brought into engagement with the peripheral edges of the holes 10*a* and 10*b*, the sleeves 11 and 12 are inserted into respective holes 10*a* 10*b* to a predetermined length as shown in FIG. 2C. As shown in FIG. 2D, the stationary electrode 4, the lead 5 and the glass bead 9 are supplied as a unit or a subassembly. After being inserted through the sleeves 11 and 12, the stationary electrode 4 and the lead 5 are welded to the sleeves 11 and 12 as shown in FIG. 2E. Thereafter the contact 13 is welded to the leading end of the stationary electrode 4 while the contact 14 is welded to the leading end of the heat responsive element 7 whose base is welded to the leading end of the subplate 6 as shown in FIG. 2F**.

The electrode mount 2 thus assembled is inserted into the glass bulb 1 and dry air is introduced into the glass tube 1 which in turn is sealed in a conventional manner. Thus the thermal protector is provided.

Figure 3:
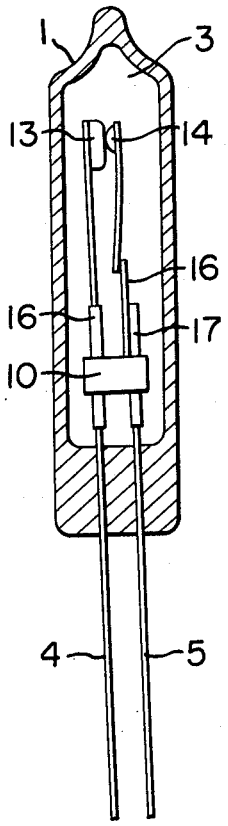
FIG. 3 is an axial sectional view of a second embodiment of the present invention.
Figure 4A:
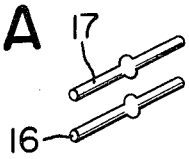
FIGS. 4A–4F are views similar to FIGS. 2A–2F.
Figure 4B:
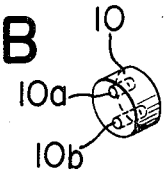
Figure 4C:
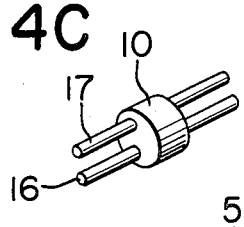
Figure 4D:
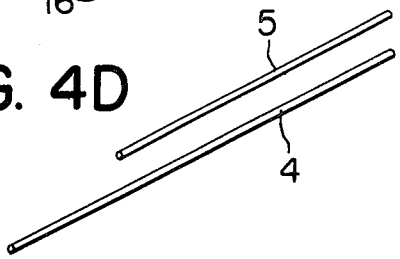
Figure 4E:
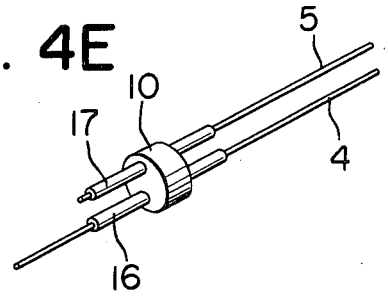
Figure 4F:
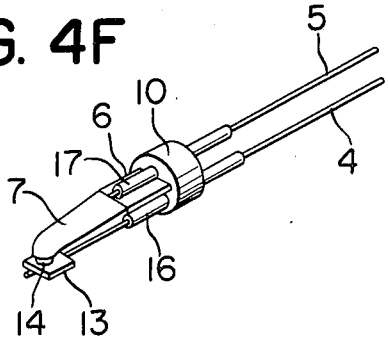

Second Embodiment, FIGS. 3 and 4

In FIG. 3 is shown, in longitudinal cross section, a second embodiment of the present invention. The embodiment is substantially similar in construction to the first embodiment described above with reference to FIGS. 1 and 2 except that (a) the glass bead 9 in the first embodiment is eliminated and the block 10 serves to maintain the stationary electrode 4 and the lead 5 in a spaced apart relationship and (b) sleeves 16 and 17 which are electrically conductive are extended through the block 10; that is, they are both extended out of the block 10. The sleeves 16 and 17 are welded at both the upper and lower ends thereof to the stationary electrode 4 and the lead 5, respectively, so that their displacement relative to the electrode 4 and the lead 5 may be completely avoided. It follows therefore that the glass bead 9 of the first embodiment can be eliminated.

The steps of the fabrication of the thermal protector with the above construction will be readily understood from FIGS. 4A–4F wherein reference is made to the steps of the fabrication of the first embodiment with reference to FIGS. 2A–2F so that no further description shall be made in this specification.

As described above, according to the present invention, the sleeves 11 and 12 are partially inserted into the holes 10*a* and 10*b* of the block 10 or the sleeves 16 and 17 are extended through the block 10 so that satisfactory, electrical and thermal joints between the stationary electrode 4 and the lead 5 on the one hand and the block 10 on the other hand may be ensured. As a consequence, the thermal protector not only operates correctly at a predetermined temperature but also exhibits excellent resistance to vibration. The present invention provides a thermal protector which is highly reliable and dependable in operation.

Furthermore the conductive sleeve 12 or 17 and the heat responsive element 7 are joined together through the subplate 6 so that the propagation of cracks at the joint of the heat responsive element 7 may be avoided when the sleeve 12 or 17 is directly welded to the heat responsive element 7.

The sleeves 11, 12, 16 and 17 can be axially slit and can have an elliptic cross section so that cracking of the positive thermistor block 10 due to a difference in coefficient of thermal expansion between the sleeves and the block may be substantially eliminated.

The results obtained from experiments with the thermal protectors in accordance with the present invention will be described. The thermal protectors which were used in the experiments were designed to open their contacts at 100° C. and to close them at 70° C. An AC voltage of 100 V was applied between the stationary electrode 4 and the lead 5. When the environmental temperature rose to 100° C., the contacts opened. Thereafter, as long as the voltage is impressed across the electrode 4 and the lead 5, the positive thermistor block 10 is heated to a predetermined temperature, of for instance 80° C., which is higher than the closing temperature of 70° C. Therefore the contacts 13 and 14 were positively kept opened. When the power switch was turned off, the contacts 13 and 14 closed.

For the sake of comparison, thermal protectors of the type in which both the stationary electrode and the lead directly extend through the holes 10*a* and 10*b* of the thermistor block 10 without the use of the sleeve 11 and 12 or 16 and 17 were fabricated. The designed contact opening and closing temperatures were same; that is, the design opening temperature was 100° C. while the design closing temperature was 70° C. They were tested under the same conditions as the thermal protectors of the present invention. The results were that the silver film electrode coated over the wall surface of the hole 10*a* or 10*b* of the block 10 became disconnected from the stationary electrode 4 or the lead 5 causing arcing between them. As a consequence the rated voltage could not be applied to the positive thermistor block and the latter did not heat to a predetermined constant temperature and consequently the contacts could not be kept open.

In another embodiment of the present invention, a heat-responsive element with an opening temperature of 130° C. and a closing temperature of 90° C. having a block of a positive thermistor which is designed to heat to a constant temperature of 100° C. are used with a similar member of a similar size as described hereinbefore to comprise a thermal protector. With this thermal protector, an experiment was conducted under the same conditions as described above. Both of the contacts opened when the environmental temperature was 130° C. Thereafter, both contacts were maintained open, by the constant temperature heating of the block, as long as the voltage was impressed across both contacts.

What is claimed is:

1. A thermal protector which comprises:

a heat responsive resistor, with a positive thermal coefficient, having two holes extending therethrough, two electrically conductive sleeves inserted into said holes in intimate contact with said heat responsive resistor, a stationary electrode having a lead extending through one of said sleeves in intimate contact with said sleeve, a movable electrode having a heat responsive element disposed in opposed relationship to said stationary electrode and adapted to move away from said stationary electrode and open contact between said electrodes when the enviromental temperature reaches a predetermined level, said movable electrode having a lead extending through said second sleeve in intimate contact with said second sleeve, said electrodes and heat responsive resistor being disposed within an air tight sealed envelope having the leads extending therefrom.

2. A thermal protector as set forth in claim 1 wherein a glass bead is welded to said movable and stationary electrodes to bridge them.

3. A thermal protector as set forth in claim 1 wherein said heat responsive resistor with a positive thermal coefficient maintains said stationary and movable electrodes in a spaced apart relationship.

4. A thermal protector as set forth in claim 1 wherein said heat responsive element and said electrically conductive sleeve are joined together through a subplate.

5. A thermal protector as set forth in claim 1 wherein said heat responsive resistor comprises a thermistor with a positive thermal coefficient.

6. A thermal protector as set forth in claim 1 wherein said stationary and movable electrodes are in intimate contact with metal films or the like coated over the wall surfaces of said holes in said heat responsive resistor with a positive thermal coefficient.

* * * * *

UNITED STATES PATENT AND TRADEMARK OFFICE

CERTIFICATE OF CORRECTION

PATENT NO. : 4,287,500

DATED : September 1, 1981

INVENTOR(S) : Kensaku Ueda

It is certified that error appears in the above—identified patent and that said Letters Patent is hereby corrected as shown below:

In the Abstract, line 9: after "through", insert --the--.

Column 1, line 52: "through" should be deleted.

Column 2, line 21: "movavle" should be --movable--.

Column 3, line 66: "sleeve" should be --sleeves--.

Signed and Sealed this

*Thirteenth* Day of *July 1982*

[SEAL]

*Attest:*

GERALD J. MOSSINGHOFF

*Attesting Officer*

*Commissioner of Patents and Trademarks*